US010822730B2

(12) United States Patent
Saito et al.

(10) Patent No.: US 10,822,730 B2
(45) Date of Patent: Nov. 3, 2020

(54) SPOOL REST AND THREAD STANDING DEVICE

(71) Applicant: JUKI CORPORATION, Tama-shi, Tokyo (JP)

(72) Inventors: Masaru Saito, Tama (JP); Yu Ikoshi, Tama (JP)

(73) Assignee: JUKI CORPORATION, Tokyo (JP)

( * ) Notice: Subject to any disclaimer, the term of this patent is extended or adjusted under 35 U.S.C. 154(b) by 0 days.

(21) Appl. No.: 16/407,360

(22) Filed: May 9, 2019

(65) Prior Publication Data

US 2019/0345657 A1 Nov. 14, 2019

(30) Foreign Application Priority Data

May 10, 2018 (JP) ..... 2018-091040

(51) Int. Cl.
*D05B 43/00* (2006.01)

(52) U.S. Cl.
CPC ..... *D05B 43/00* (2013.01)

(58) Field of Classification Search
CPC ..... D05B 43/00; D05B 91/14; B65H 59/04
USPC ..... 112/231
See application file for complete search history.

(56) References Cited

U.S. PATENT DOCUMENTS 463,822 A * 11/1891 Bates ..... B65H 2701/31
1,580,687 A * 4/1926 Selbst ..... D05B 91/14 242/139
3,690,584 A * 9/1972 Wilkerson ..... B65H 49/06 242/128
5,707,021 A * 1/1998 Bitts ..... B65H 49/16 112/152
5,842,655 A * 12/1998 McCarthy ..... B65H 49/28 242/129
7,219,611 B1 * 5/2007 Troncoso ..... D05B 43/00 112/302
2012/0125245 A1 * 5/2012 Troncoso ..... B65H 57/18 112/302

FOREIGN PATENT DOCUMENTS

JP 2000-5476 A 1/2000

* cited by examiner

*Primary Examiner* — Tajash D Patel
(74) *Attorney, Agent, or Firm* — Faegre Drinker Biddle & Reath LLP

(57) ABSTRACT

A spool rest is provided in a thread standing device of a sewing machine so as to hold a thread spool to be attachable and detachable by inserting a support installed to protrude from a thread standing base, in a cylinder portion formed at a center of the thread spool around which a sewing thread to be fed to the sewing machine is wound, the spool rest is a polygonal plate installed on the thread standing base and includes a through-hole that the support provided at a center portion of a placement surface for placing the thread spool penetrates, and a thread passing groove is formed from the center portion of the placement surface toward an outer edge portion.

12 Claims, 5 Drawing Sheets

SPOOL REST AND THREAD STANDING DEVICE

CROSS-REFERENCE TO RELATED APPLICATIONS

The present application claims the benefit of priority of Japanese Patent Application No. 2018-091040, filed on May 10, 2018, the content of which is incorporated herein by reference.

TECHNICAL FIELD

The present invention relates to a spool rest on which a thread spool, around which a sewing thread to be fed to a sewing machine is wound, is placed.

BACKGROUND ART

In the related art, as illustrated in FIG. 7, a thread standing device for feeding a sewing thread to a sewing machine is placed on a circular spool rest 120 on which a thread spool, around which the sewing thread is wound, is installed on a thread standing base 130, the sewing thread is passed through a thread guide 101 supported above the spool rest 120, and the sewing thread wound around the thread spool is supplied to the sewing machine after being fed out toward the upper thread guide 101 (for example, refer to JP2000-005476A).

However, in a structure of the related art in which the sewing thread is fed out above the thread spool, there is a problem that the sewing thread is likely to be unwound from the thread spool when the sewing thread oriented toward the thread guide from the thread spool is loosened due to its own weight. This is particularly noticeable in a case where the sewing thread wound around the thread spool is thick and durable.

In addition, when the sewing thread unwound from the thread spool falls below the thread standing base 130, the sewing thread is entangled in the thread standing base 130 or a support stand 100 thereof, the feeding becomes impossible, and there was a concern that thread breakage occurs.

In a case of a soft thread, there is a concern that a tension of the thread changes due to the influence of air from an air conditioner or the like and the sewing condition changes, or the thread is entangled with the adjacent thread.

SUMMARY

An aspect of the present invention is to prevent generation of slack due to unwinding of a sewing thread from a thread spool and to stabilize a feeding state of the thread.

According to an aspect of the present invention, there is provided a spool rest that is provided in a thread standing device of a sewing machine so as to hold a thread spool to be attachable and detachable by inserting a support installed to protrude from a thread standing base, in a cylinder portion formed at a center of the thread spool around which a sewing thread to be fed to the sewing machine is wound, the spool rest being a polygonal plate installed on the thread standing base and including a through-hole that the support provided at a center portion of a placement surface for placing the thread spool penetrates, and a thread passing groove formed from the center portion of the placement surface toward an outer edge portion.

According to an aspect of the present invention, the polygonal plate has a rectangular shape.

According to an aspect of the present invention, the polygonal plate has a square shape.

According to an aspect of the present invention, the width of the thread passing groove is expanded from the center portion of the placement surface toward the outer edge portion.

According to an aspect of the present invention, there is provided a thread standing device of a sewing machine to hold the thread spool to be attachable and detachable, the device comprising:

the spool rest according to any one of claims 1 to 4;

the thread spool; and a thread standing base from which the support is installed to protrude, wherein the thread spool includes a flange portion integrally formed in a lower end portion of the cylinder portion, and the spool rest has a size in which the entire flange portion is capable of being disposed to be an inner side of the placement surface in a plan view.

As described above, according to an aspect of the present invention, it is possible to form a thread path through which the sewing thread passes the cylinder portion of the thread spool by the thread passing groove. Therefore, it is possible to feed out the sewing thread while pulling the sewing thread to the center side of the thread spool, and even in a case where a thread diameter is large and strong, it is possible to reduce the occurrence of unwinding of the sewing thread on the outermost layer.

Therefore, it becomes possible to reduce the occurrence of the entanglement of the sewing thread unwound from the thread spool and to realize the stable feeding of the sewing thread.

DETAILED DESCRIPTION

An embodiment of the present invention will be described. The embodiment illustrates a thread standing device that holds a thread spool 30 for feeding a sewing thread T to a sewing machine.

Figure 1:
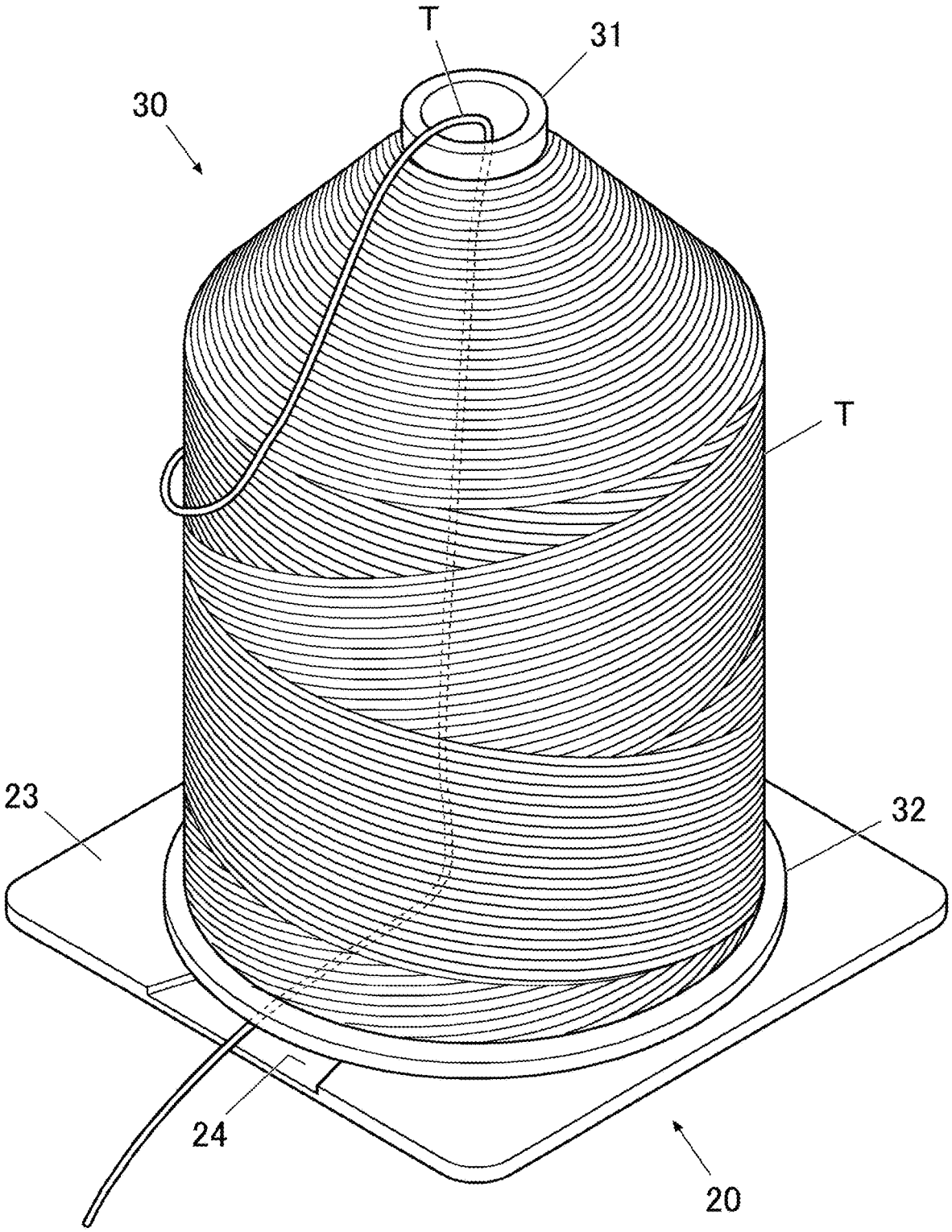
FIG. 1 is a perspective view of a spool rest in a state where a thread spool is placed thereon.
Figure 2:
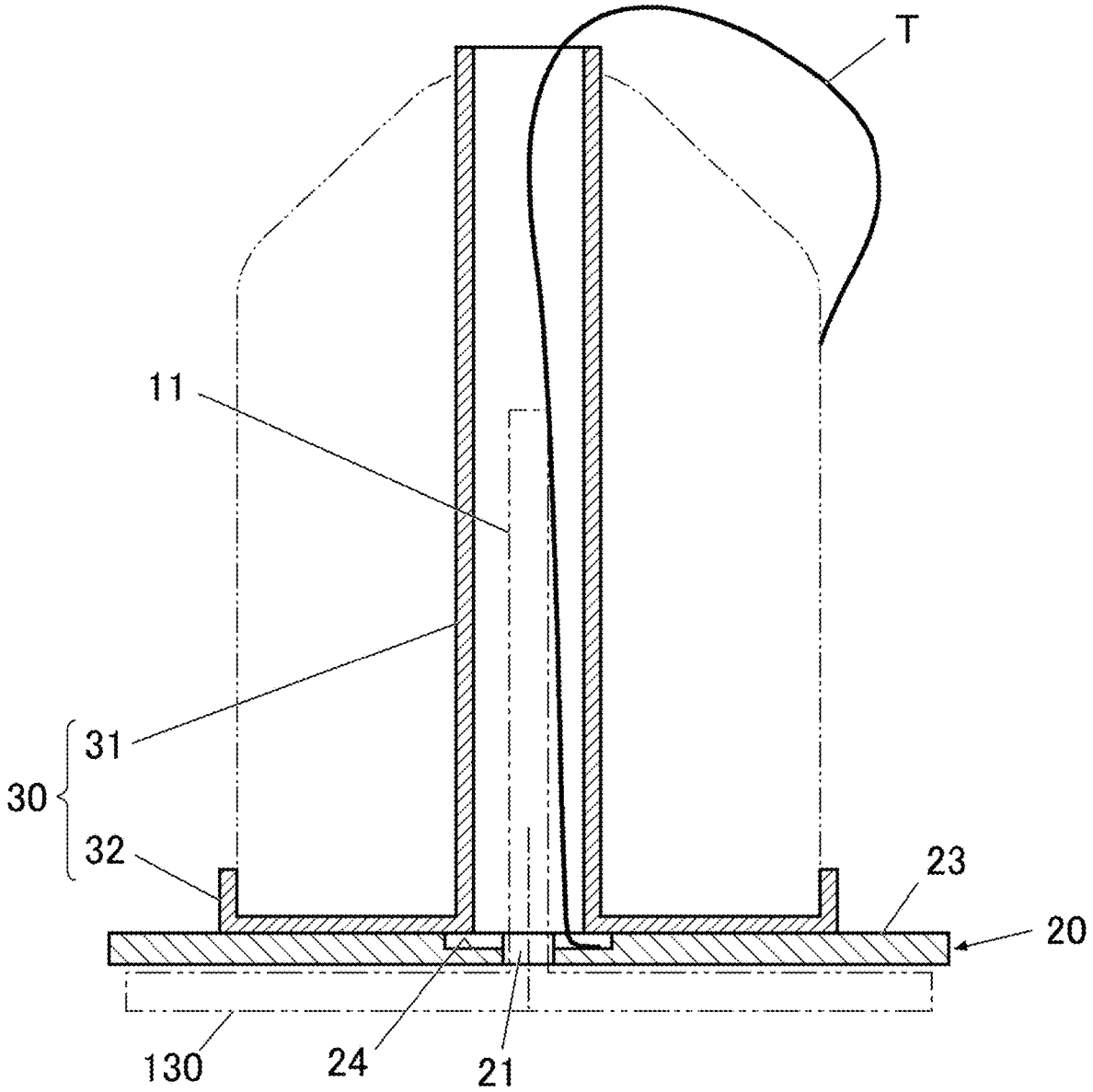
FIG. 2 is a sectional view along a direction perpendicular to a flat plate surface of the spool rest in a state where the thread spool is placed thereon.
Figure 3:
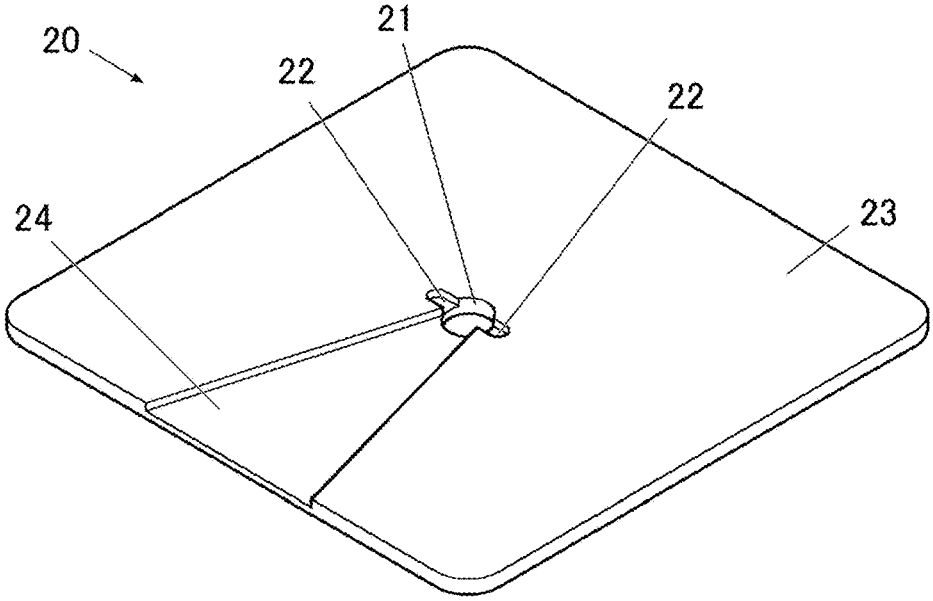
FIG. 3 is a perspective view of the spool rest alone.

FIG. 1 is a perspective view of the thread standing device in a state where the thread spool 30 is placed thereon, FIG. 2 is a sectional view along a direction perpendicular to a flat plate surface of the thread standing device in a state where the thread spool 30 is placed thereon, and FIG. 3 is a perspective view of a spool rest 20 alone.

The thread standing device includes the thread spool 30, a thread standing base 130 having a shape of a flat plate, a support 11 that stands in a center portion on an upper surface of the thread standing base 130, and the spool rest 20 placed on the upper surface of the thread standing base 130 in a state of penetrating the support 11.

Thread Spool

The thread spool 30 includes a cylinder portion 31 around which the sewing thread T is wound, and a flange portion 32 integrally provided in a lower end portion of the cylinder portion 31.

The cylinder portion 31 is hollow over the entire length, and an outer diameter and an inner diameter are constant over the entire length.

The flange portion 32 is integrally formed with the cylinder portion 31 and has a disk shape having a sufficiently large outer diameter than that of the cylinder portion 31.

The thread spool 30 is used by being placed on the thread standing base 130 such that the cylinder portion 31 is parallel to a vertical up-down direction in a state where the flange portion 32 side faces downward.

At this time, the cylinder portion 31 of the thread spool 30 is inserted into the support 11 installed to protrude from the thread standing base 130, and the thread spool 30 is held to be attachable and detachable.

In addition, the sewing thread T is wound in layers around an outer periphery of the cylinder portion 31 of the thread spool 30, unwound sequentially from the outermost layer, and fed to the sewing machine.

Further, the thread T is wound in layers in a range that is an inner side of the outer diameter of the flange portion 32.

Spool Rest

The spool rest 20 is a square flat plate having a uniform thickness, and four corner portions are rounded in an arc shape.

In the spool rest 20, a through-hole 21 is formed in a center portion, and short slits 22 are formed in both end portions of the through-hole 21 in a diametrical direction.

The spool rest 20 is supported on the thread standing base 130 on which the support 11 stands such that the flat plate surface becomes horizontal in a state where the support 11 passes through the through-hole 21.

One flat plate surface of the spool rest 20 is used as a placement surface 23 of the above-described thread spool 30, and is used in a state where the placement surface 23 faces upward while the spool rest 20 is supported by the thread standing base 130.

In addition, a thread passing groove 24 that is one step lower than the placement surface 23 is formed from the center of the placement surface 23 to an outer edge portion thereof.

The groove width of the thread passing groove 24 is expanded from the center toward the outer edge portion. In addition, the thread passing groove 24 is formed in a direction in which the center line of the groove width is orthogonal to the outer edge portion which is one side of the square from the center of the placement surface 23 of the spool rest 20.

The placement surface 23 of the spool rest 20 is set such that the length of one side of the square is longer than the outer diameter of the flange portion 32 of the large thread spool 30. Therefore, when the thread spool 30 is placed on the placement surface 23 of the spool rest 20 such that the center of the spool rest 20 and the center of the flange portion 32 of the thread spool 30 match each other, the thread spool 30 can be disposed such that the entire flange portion 32 becomes the inner side of the placement surface 23 of the spool rest 20 in a plan view.

When the thread spool 30 is placed on the spool rest 20 including the thread passing groove 24, as illustrated in FIG. 2, a gap is formed by the thread passing groove 24 between the flange portion 32 of the thread spool 30 and the spool rest 20.

Therefore, it is possible to insert the sewing thread T from an upper end portion of the cylinder portion 31 of the thread spool 30 and to form a thread path from the thread passing groove 24 to the outside through the inside of the cylinder portion 31.

Technical Effects of Embodiment

In the related art, since the thread path toward which the sewing thread T is oriented is formed in a thread guide positioned above the thread spool 30, the sewing thread T in a state of being wound on the outermost layer of the thread spool 30 is likely to be unwound at the moment of slack by its own weight.

Meanwhile, in the spool rest 20, it is possible to form the thread path through which the sewing thread T passes the cylinder portion 31 of the thread spool 30 by the thread passing groove 24. Therefore, it is possible to feed out the sewing thread T while pulling the sewing thread T to the center side of the thread spool 30, and even in a case where a thread diameter is large and strong, it is possible to reduce the occurrence of unwinding of the sewing thread T on the outermost layer.

Therefore, it becomes possible to reduce the occurrence of the entanglement of the sewing thread T unwound from the thread spool 30 and to realize the stable feeding of the sewing thread T.

Unlike the related art, it is not necessary to provide a thread guide 101 (refer to FIG. 7) above the spool rest, and it is possible to simplify a structure of the support stand. Furthermore, the size of the entire configuration including the spool rest 20 and the support stand can be reduced in an up-down direction.

In addition, since it is not necessary to guide the sewing thread T to the upper thread guide 101, the sewing thread T from the thread spool 30 toward the thread guide 101 is shaken by the influence of air or the like from an air conditioner, and the concern that the tension of the sewing thread T changes is disappeared. Therefore, it becomes possible to obtain a stable feeding state with a wide variety of threads, such as thick threads and thin soft threads.

Next, a case where the shape of the spool rest 20 in a plan view is a square will be described with reference to FIGS. 4 to 6.

Since the shape of the spool rest of the related art in a plan view has a circular shape, it is possible to capture the sewing thread T unwound from the thread spool 30 only in a range that corresponds to a radius of the spool rest from the center.

Figure 4:
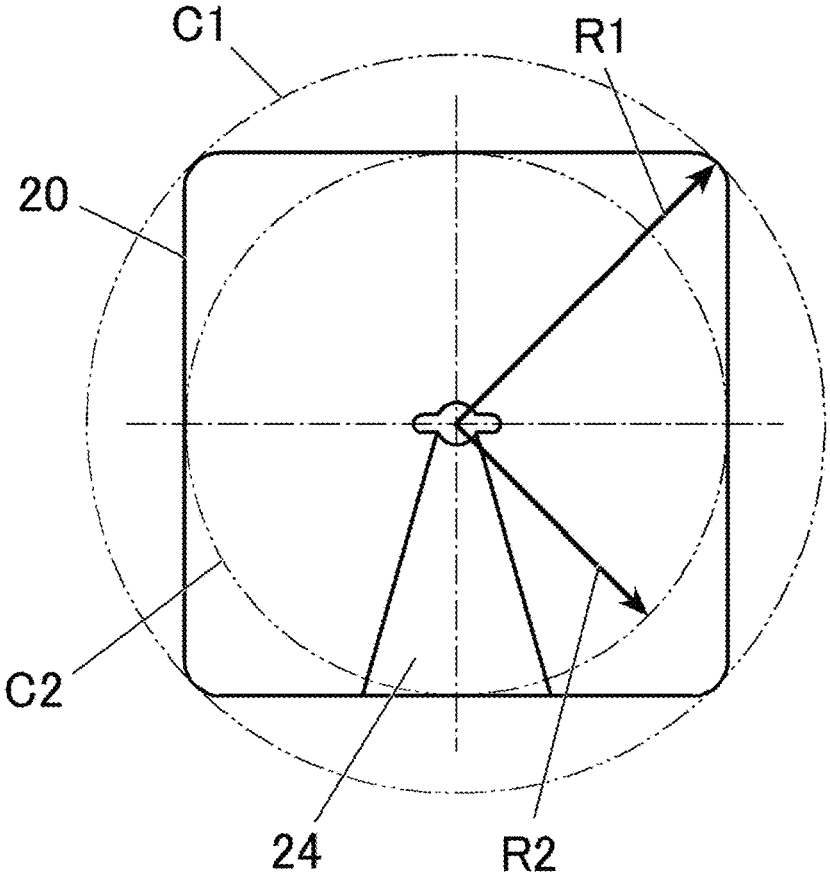
FIG. 4 is a plan view illustrating a thread capture range of the spool rest.

Meanwhile, since the spool rest 20 has a square outer shape, as illustrated in FIG. 4, a capturing effect of the unwound sewing thread T extends to a range of the circular spool rest having the same outer diameter not as that of an inscribed circle C2 having a radius R2 but as that of a circumscribed circle C1 (R1>R2) having a radius R1.

Figure 5:
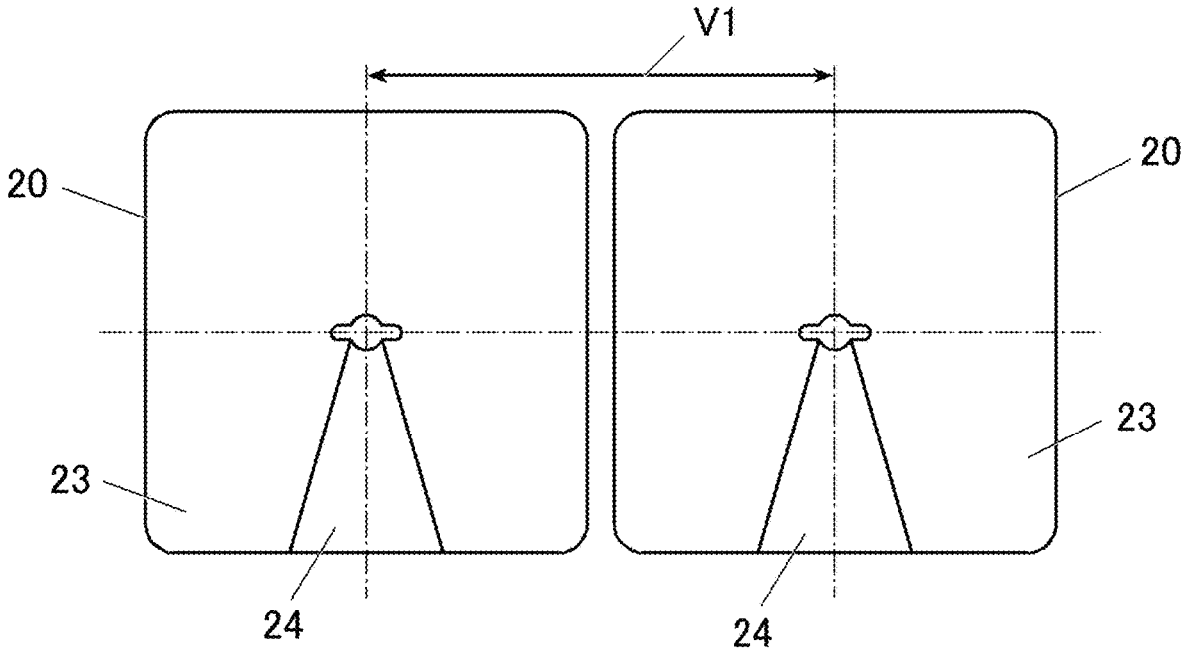
FIG. 5 is a plan view illustrating a center-to-center distance in a case where two spool rests according to an embodiment of the present invention are arranged.

Meanwhile, in a case where a plurality of spool rests 20 are used side by side, in the square spool rest 20, as illustrated in FIG. 5, a center-to-center distance V1 between two adjacent spool rests 20 can be the same length as that of the circular spool rest having the same outer diameter as that of the inscribed circle C2.

Figure 6:
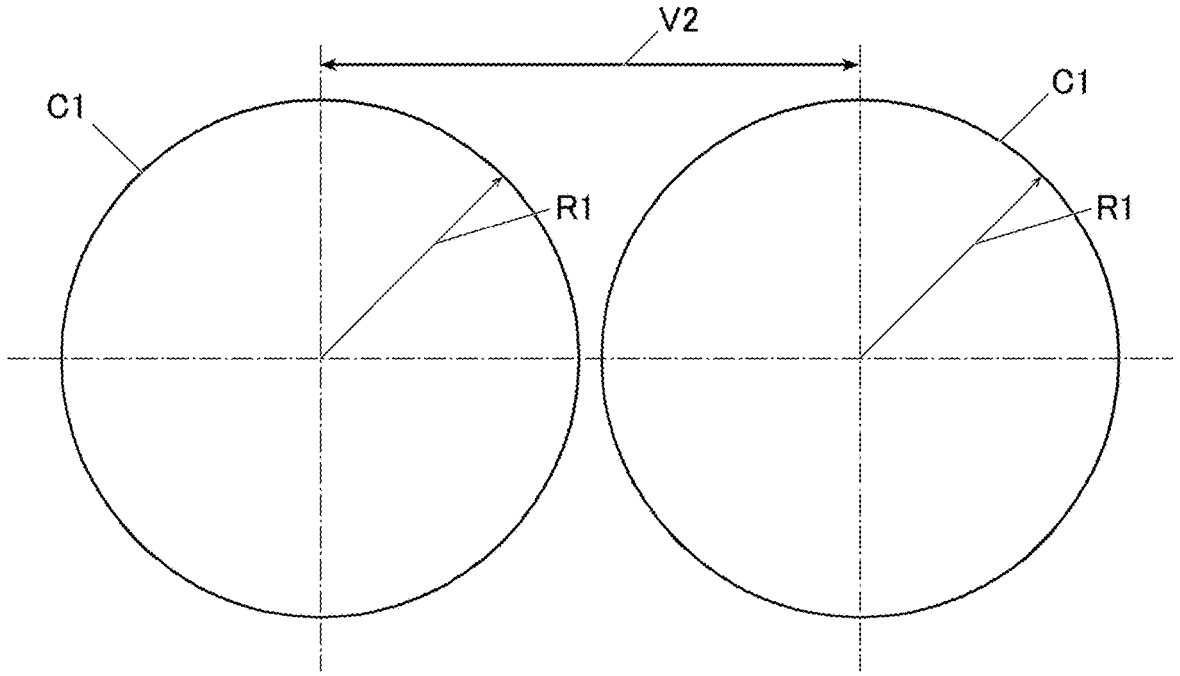
FIG. 6 is a plan view illustrating a center-to-center distance in a case where two circular spool rests having a radius R1 are arranged.

Meanwhile, as illustrated in FIG. 6, in a case of the circular spool rest having the same outer diameter as that of the circumscribed circle C1 having the radius R1 of which the thread capturing effect is the same as that of the spool rest 20, a center-to-center distance V2 is much larger than the center-to-center distance V1 of the spool rest 20.

For example, in a case of simple calculation without considering a gap between two spool rests, it becomes possible to reduce the center-to-center distance V1 of the spool rest 20 to V1=V2×cos 45°≈V2×0.71 as compared with the center-to-center distance V2 of the spool rest 120 of the related art.

In other words, the spool rests 20 can be disposed side by side in a narrow range while maintaining a high capturing effect of the sewing thread T unwound from the thread spool 30 by making the outer shape into a square shape.

In addition, the spool rest 20 has a through-hole 21 formed at the center. Therefore, in a case of a place where the support 11 (refer to FIG. 2) is provided, it is easy to install the spool rest 20, and it becomes possible to simplify the structure of the support stand or the like on which the spool rest 20 and the thread spool 30 are installed.

Figure 7:
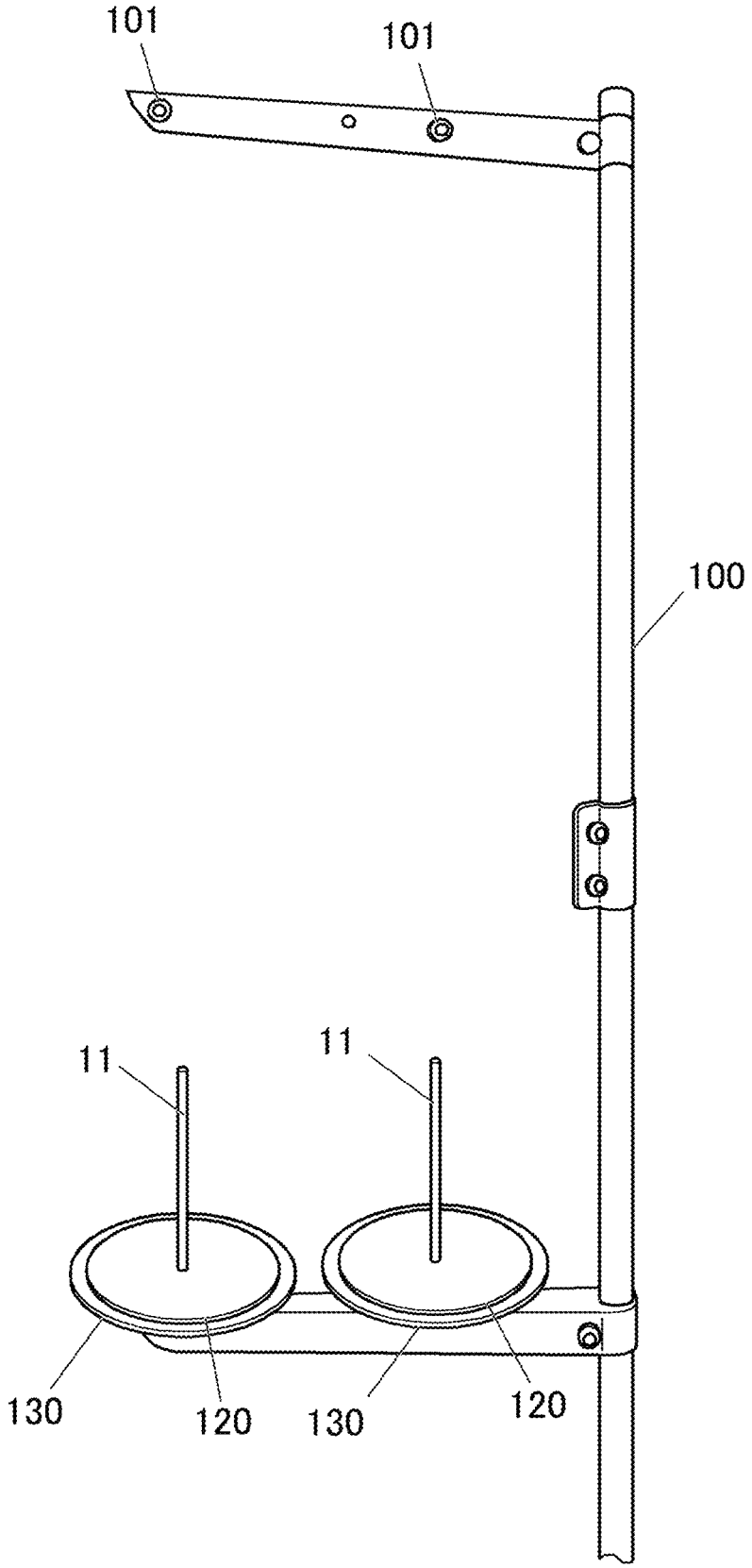
FIG. 7 is a perspective view illustrating a support stand of a spool rest of the related art.

For example, the thread standing base 130 of the related art illustrated in FIG. 7 includes the support 11 that stands at the center portion of the thread standing base 130.

Therefore, the support 11 penetrates the through-hole 21 and the spool rest 20 can also be easily installed in a support stand 100 of the related art by superposing the spool rest 20 on the thread standing base 130. In other words, the spool rest 20 can also utilize the existing support stand 100.

In addition, the thread passing groove 24 can be smoothly delivered toward a wider range of the fed-out sewing thread T since the width is expanded from the center portion of the placement surface 23 toward the outer edge portion.

Further, since the thread passing groove 24 is formed in a direction orthogonal to one side of the square and is formed avoiding the square corner portion, in a case where the two or more spool rests 20 are disposed side by side, it becomes possible to smoothly deliver the sewing thread T without interference of the fed-out sewing thread T with the adjacent spool rest 20.

Others

In addition, regarding the spool rest 20, a structure in which the entire thickness is uniform is exemplified, but the thickness may be non-uniform. For example, a structure in which the center portion is thickened, or only the outer edge portion is thickened to have an edge, may be employed.

In addition, regarding the spool rest 20, a case where the placement surface 23 side on which the thread passing groove 24 was formed is smooth is exemplified, but the placement surface 23 side may not be smooth. For example, a form of a dish or mortar in which the center portion is recessed may be employed.

In addition, in the spool rest 20, a case where the shape in a plan view (the shape viewed from the center line direction of the placed thread spool 30) is a square is exemplified, but even in a case of a rectangle or a polygon, more preferably a regular polygon, it is possible to dispose the spool rests 20 side by side in a narrow range while maintaining a high capturing effect of the sewing thread T unwound from the thread spool 30.

In addition, the thread passing groove 24 is formed to go across from the center portion of the spool rest 20 to the outer edge portion. However, when extending to the outside of the flange portion 32 of the thread spool 30, it is possible to form the thread path through which the sewing thread T passes the cylinder portion 31 of the thread spool 30. Therefore, although the smoothness of the delivery of the sewing thread T slightly deteriorates, the thread passing groove 24 may be configured to be formed up to the vicinity of the outer edge portion.

The invention claimed is:

1. A spool rest that is provided in a thread standing device of a sewing machine so as to hold a thread spool to be attachable and detachable by inserting a support installed to protrude from a thread standing base, in a cylinder portion formed at a center of the thread spool around which a sewing thread to be fed to the sewing machine is wound, the spool rest being a polygonal plate installed on the thread standing base and including a through-hole that the support provided at a center portion of a placement surface for placing the thread spool penetrates, and a thread passing groove formed from the center portion of the placement surface toward an outer edge portion.

2. The spool rest according to claim 1, wherein the polygonal plate has a rectangular shape.

3. The spool rest according to claim 2, wherein the polygonal plate has a square shape.

4. The spool rest according to claim 1, wherein the width of the thread passing groove is expanded from the center portion of the placement surface toward the outer edge portion.

5. The spool rest according to claim 2, wherein the width of the thread passing groove is expanded from the center portion of the placement surface toward the outer edge portion.

6. The spool rest according to claim 3, wherein the width of the thread passing groove is expanded from the center portion of the placement surface toward the outer edge portion.

7. A thread standing device of a sewing machine to hold the thread spool to be attachable and detachable, the device comprising:

the spool rest according to claim 1;

the thread spool; and a thread standing base from which the support is installed to protrude, wherein the thread spool includes a flange portion integrally formed in a lower end portion of the cylinder portion, and the spool rest has a size in which the entire flange portion is capable of being disposed to be an inner side of the placement surface in a plan view.

8. A thread standing device of a sewing machine to hold the thread spool to be attachable and detachable, the device comprising:

the spool rest according to claim 2;

the thread spool; and a thread standing base from which the support is installed to protrude, wherein the thread spool includes a flange portion integrally formed in a lower end portion of the cylinder portion, and the spool rest has a size in which the entire flange portion is capable of being disposed to be an inner side of the placement surface in a plan view.

9. A thread standing device of a sewing machine to hold the thread spool to be attachable and detachable, the device comprising:

the spool rest according to claim 3;

the thread spool; and a thread standing base from which the support is installed to protrude, wherein the thread spool includes a flange portion integrally formed in a lower end portion of the cylinder portion, and the spool rest has a size in which the entire flange portion is capable of being disposed to be an inner side of the placement surface in a plan view.

10. A thread standing device of a sewing machine to hold the thread spool to be attachable and detachable, the device comprising:

the spool rest according to claim 4;

the thread spool; and a thread standing base from which the support is installed to protrude, wherein the thread spool includes a flange portion integrally formed in a lower end portion of the cylinder portion, and the spool rest has a size in which the entire flange portion is capable of being disposed to be an inner side of the placement surface in a plan view.

11. A thread standing device of a sewing machine to hold the thread spool to be attachable and detachable, the device comprising:

the spool rest according to claim 5;

the thread spool; and a thread standing base from which the support is installed to protrude, wherein the thread spool includes a flange portion integrally formed in a lower end portion of the cylinder portion, and the spool rest has a size in which the entire flange portion is capable of being disposed to be an inner side of the placement surface in a plan view.

12. A thread standing device of a sewing machine to hold the thread spool to be attachable and detachable, the device comprising:

the spool rest according to claim 6;

the thread spool; and a thread standing base from which the support is installed to protrude, wherein the thread spool includes a flange portion integrally formed in a lower end portion of the cylinder portion, and the spool rest has a size in which the entire flange portion is capable of being disposed to be an inner side of the placement surface in a plan view.

* * * * *